US005587564A

United States Patent [19]

Stief et al.

[11] Patent Number: 5,587,564

[45] Date of Patent: Dec. 24, 1996

[54] NOISE DAMPER

[75] Inventors: Reinhard Stief, Weinheim; Gerhard Muller-Broll, Rimbach, both of Germany

[73] Assignee: Firma Carl Freudenberg, Weinheim, Germany

[21] Appl. No.: 419,687

[22] Filed: Apr. 10, 1995

[30] Foreign Application Priority Data

Apr. 27, 1994 [DE] Germany ..... 44 14 566.7

[51] Int. Cl.[6] ..... E04B 1/82

[52] U.S. Cl. ..... 181/295; 181/286; 181/293

[58] Field of Search ..... 181/286, 290, 181/295, 293, 294

[56] References Cited

U.S. PATENT DOCUMENTS

| | | | |
|---|---|---|---|
| 2,124,463 | 7/1938 | Cunnington . | |
| 2,887,173 | 5/1959 | Boschi | 181/286 |
| 3,269,484 | 8/1966 | Lighter . | |
| 4,149,612 | 4/1979 | Baschorr . | |
| 4,242,398 | 12/1980 | Segawa et al. . | |
| 4,425,981 | 11/1984 | Kiesewetter et al. | 181/286 |
| 4,584,232 | 4/1986 | Frank et al. . | |
| 4,821,841 | 4/1989 | Woodward et al. | 181/286 |
| 5,024,290 | 6/1991 | Birker . | |

FOREIGN PATENT DOCUMENTS

| | | |
|---|---|---|
| 2040076 | 10/1991 | Canada . |
| 4011705A1 | 10/1991 | Germany . |

*Primary Examiner*—Khanh Dang
*Attorney, Agent, or Firm*—Kenyon & Kenyon

[57] ABSTRACT

A noise damper comprising a molded part of polymer material having at least two chambers which are designed as resonators with resonant frequencies that differ from one another. The molded part consists of a closed-cell material. The resonators are formed of essentially cup-shaped protrusions that open toward the sound source, the molded part on the side facing the sound source being covered by an orifice plate comprising at least two openings leading into each chamber. The molded part and the orifice plate are detachably joined together.

17 Claims, 2 Drawing Sheets

NOISE DAMPER

BACKGROUND OF THE INVENTION

The invention relates to a noise damper comprising a molded part of polymer material having at least two chambers, which are designed as resonators with resonant frequencies that differ from one another, with the resonators covering essentially the entire area of the molded part.

Such a noise damper is disclosed by German Patent Application DE 40 11 705, which corresponds to the English language Canadian Patent Application 2,040,076. A prior art noise damper in accordance with that patent application comprises a sound absorbing molded part, which is covered on its top surface directed toward the sound source with a porous layer or consists of open-celled foamed plastic. The resonators of that molded part are designed as Helmholtz resonators, each Helmholtz resonator having a single opening on the side facing the sound source.

SUMMARY OF THE INVENTION

An object of the present invention is to provide an improved noise damper so as to render possible a broader-band sound absorption and to enable the damper to be used in damp locations and/or clean rooms.

Within the scope of the present invention, the molded part consists of a closed-cell material, the resonators are formed as essentially cup-shaped protrusions that open toward the sound source, the molded part on the side facing the sound source is covered by an orifice plate which has at least two openings in the area of each resonator, and the molded part and the orifice plate are detachably joined together.

Due to these improvements and the advantageous operating characteristics, the noise damper according to the invention can be used in clean rooms, because it does not release any material particles from the molded part and/or from the orifice plate to the ambient air, and because it does not absorb any moisture. As a result, bacteria are reliably prevented from settling. By detachably joining the molded part to the orifice plate by a clamping system, for example, the entire noise damper can be easily cleaned.

In comparison to Helmholtz resonators, which have resonators with only one opening on the side facing the sound source, an essentially broader-band sound absorption is obtainable by the noise damper of the present invention. The number of openings is apportioned to the volume of the chambers of the corresponding resonators so as to produce a good sound absorption within a frequency range of at least 250 to 4000 Hz. In contrast, noise dampers designed as Helmholtz resonators can only absorb sound satisfactorily within a frequency range of 750 to 1500 Hz.

The sound striking the noise damper initially penetrates through the openings in the orifice plate and excites the chamber bottom and the side walls of each chamber to vibration. A portion of the energy is converted into heat by the inner friction of the molded part material. The remaining portion of the energy is damped by the oscillating air columns in the openings of the orifice plate. Therefore, even just one chamber of the molded part covered by an orifice plate with multiple openings makes it possible to have a comparatively broader-band damping of impacting sound, because, for example, air columns having dissimilar volumes vibrate inside the different openings of the orifice plate.

In accordance with one advantageous embodiment, the molded part may consist of a closed-cell foamed plastic, and the orifice plate may be made of metallic material. This embodiment is advantageous in that the noise damper does not absorb any moisture and, therefore, can be reliably used in wet locations or clean rooms. Therefore, the noise damper is suitable for use in the food processing industry and in the medical field. From a standpoint of production engineering and economics, it is advantageous to manufacture the molded part from a closed-cell molded plastic and the orifice plate from a metallic material.

The molded component can be provided with resonators of the same volume having conforming designs, with the number and/or shape of the openings in the perforated plate differing for different resonators. In the case of a noise damper having such a design, the flexural stiffness of the chambers correspond to one another; the wide-band absorption of sound is achieved by the variation of the openings in the orifice plate. In order to achieve this wide-band absorption, the volumes of the air columns inside the openings are dissimilar.

Another embodiment provides for the molded part to be designed with resonators having differing volumes and for the perforated plate to have a conforming or a dissimilar number and/or shape of openings in the area of each of the resonators. It is possible for the molded part having differently shaped resonators to be covered by a uniformly perforated orifice plate. Because the resonators have different shapes, each of them can have a distinct flexural stiffness, so that a good wide-band sound absorption is provided within a frequency range of 250 to 4000 Hz.

In accordance with one advantageous embodiment, the resonators can be designed with the chamber bottom arranged to allow it to vibrate relatively to the side walls of the chamber. The transition region from the side walls to the chamber bottom can be designed as a spring element which starts from the side walls and the chamber bottom and gradually merges into a reduced, membrane-like thin material thickness. The spring element can have a rolling-diaphragm-type design to allow the chamber bottom to move easily relatively to the side walls of the chamber. Chambers designed accordingly form a spring-mass system, in the case of which the spring is constituted by the air trapped inside the chamber and by the elastically flexible spring element, which is arranged in the transition region between the side walls of the chamber and the chamber bottom. The mass is made up of the relatively oscillatory chamber bottom. Because the chamber bottom is coupled elastically to the side walls of the chamber, the sound absorption in the lower frequency ranges can be improved. This type of design makes it possible to have a sound absorption in a frequency range of between 100 and 4000 Hz. Because the spring element preferably has a rolling-diaphragm-type design, an oscillatory motion of the chamber bottom relative to the side walls of the chamber produces only a slight mechanical flexing strain, which is advantageous in providing a durable design for the noise damper.

It has proven to be advantageous for the ratio of the sum of the surface areas of all openings to the total surface area of the orifice plate to be 0.05 to 0.45. With such a construction, an excellent broad-band sound absorption is achieved with a good mechanical dimensional stability of the entire noise damper.

According to one embodiment, the openings may have a circular shape with a diameter of not more than 4 mm. The openings preferably have a diameter of 1 to 3 mm, with the resonators having dissimilar shapes from one another. If the diameter of the openings amounts to less than 4 mm, impurities inside the chambers are limited to small particles.

With respect to a problem-free manufacturing of the molded part and a simple cleaning, it has proven to be advantageous for the resonators to have a cross-section that widens conically in the direction of the orifice plate. Following its plastic shaping, the molded part can be removed from the mold quite simply by the conical form of the resonators. The essentially conical chambers guarantee that any condensate will run off, so that no moisture residues, for example as may be left over from the cleaning of the noise damper inside the resonators. The condensate is carried off through the openings of the orifice plate to the outside.

A further increased frequency range for absorbing sound can be effected in that the molded part is only partially provided with a heavy layer on the side facing away from the orifice plate. The resonators provided with a heavy layer produce an improved sound absorption of comparatively lower-frequency vibrations.

A noise damper according to the present invention can be used as a ceiling and/or wall covering in moist locations and/or clean rooms.

DETAILED DESCRIPTION OF THE DRAWINGS

Figure 1:
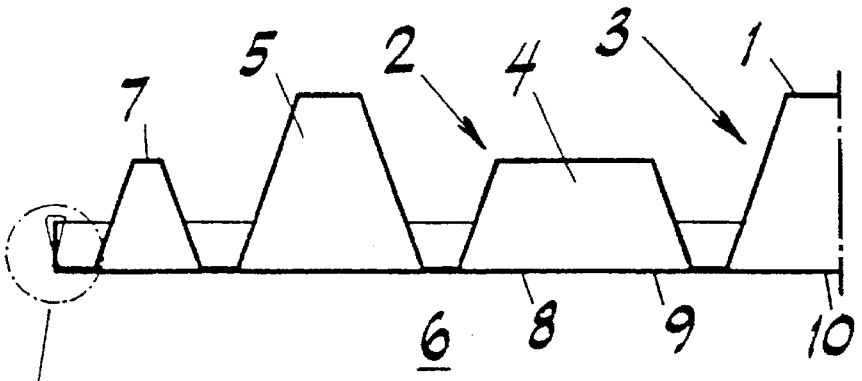
FIG. 1 shows a noise damper designed as a sound absorbing element, in cross-section.
Figure 1A:
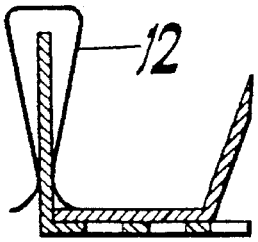
FIG. 1A shows an enlarged cross-sectional view of the area labeled X in FIG. 1.

FIG. 1 shows an embodiment of a noise damper, essentially consisting of a plate shaped molded part 1 and an orifice plate 8. The molded part 1 is manufactured from a closed-cell polymer material and comprises a plurality of chambers 2, 3, which are designed as resonators 4, 5. In this exemplary embodiment, the volumes of the resonators 4, 5 (generally referred to as protrusions 7) differ so that their resonant frequencies are dissimilar. The resonators 4, 5 open out toward the sound source 6 and are covered by the orifice plate 8. The orifice plate 8 is provided in the area of each protrusion 7 with a plurality of openings 9, 10, in order to effect, in conjunction with the resonators 4, 5, a good sound absorption within a frequency range of at least 250 to 4000 Hz.

The molded part 1 and the orifice plate 8 are joined together detachably by means of a clamp-type fixing device 12. It is provided in the exemplary embodiments shown here for the orifice plate 8 to consist of a metallic material and to be joined to the molded part under elastic prestressing. Upon manufacturing, the orifice plate 8 is curved in a dome shape, similarly to the resonators. During assembly, the orifice plate 8 is transformed under elastic prestressing into a flat state and, by this means, tightly joined to the molded part 1.

Figure 2:
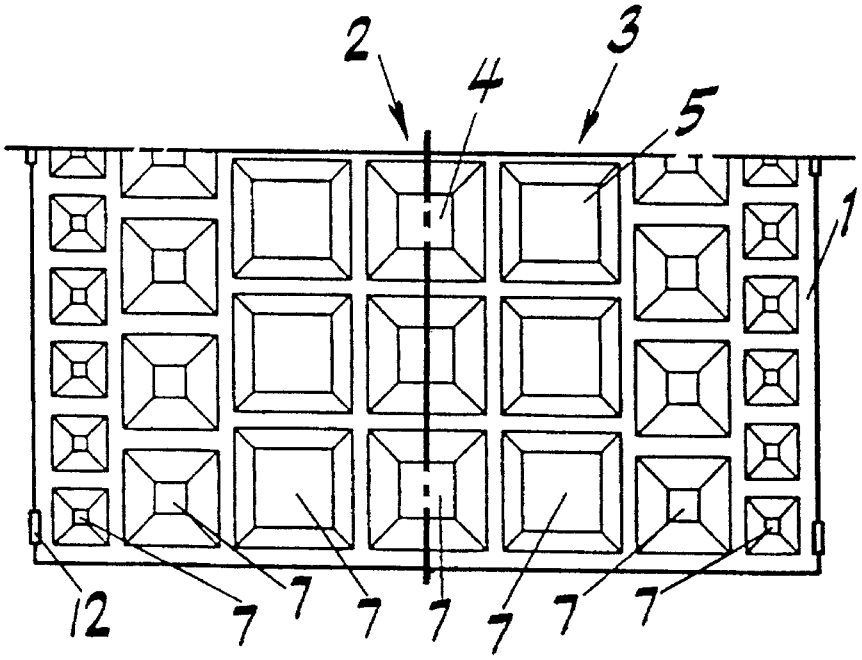
FIG. 2 shows a top view of the noise damper of FIG. 1.

FIG. 2 illustrates a top view of the noise damper of FIG. 1. This view shows the dissimilarity of the designs of the resonators 4, 5.

Figure 3:
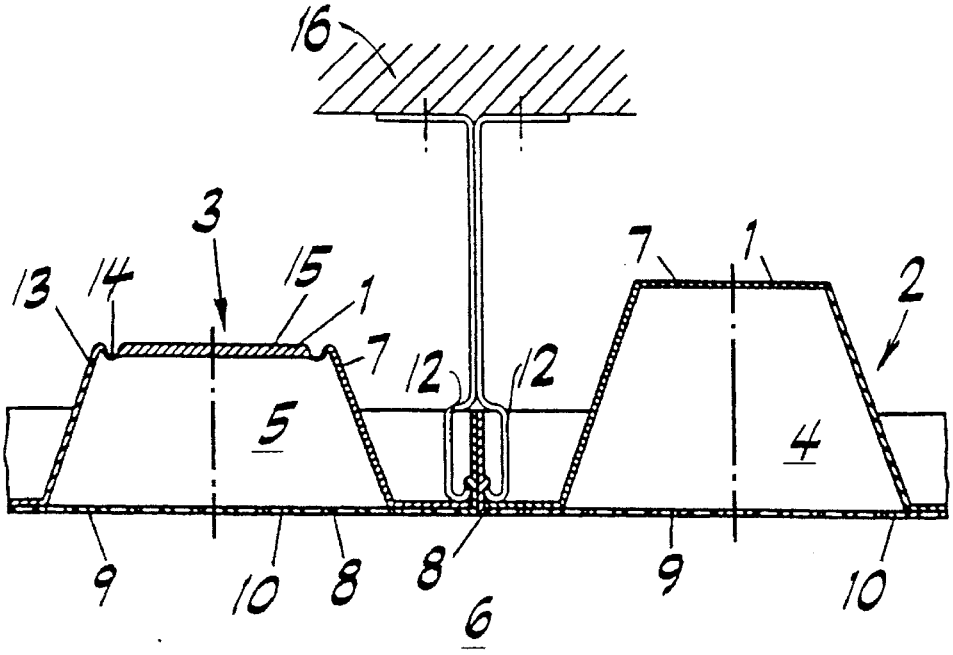
FIG. 3 shows a detail of a noise damper comprised of a plurality of sound absorbing elements, the sound absorbing elements being designed as a ceiling covering.

FIG. 3 depicts a detail of at least two noise dampers which are joined together in the area of their peripheral side boundary edges by the clamp-type fixing device 12. In addition to joining the noise dampers together, the clamp-type fixing device 12 also joins the plate-shaped molded parts 1 to each of the adjacent orifice plates 8.

Similar to the embodiment of FIG. 1, the resonators 4, 5 have dissimilar shapes. The resonator 4 is sealed by an orifice plate which has differently shaped openings. The diameters of the openings amount to 1 to 3 mm. The resonator 5 is covered by an orifice plate which has a plurality of identically designed openings. In addition, the resonator 5 is designed as a spring-mass system, the side walls 13 of the chamber 3 being joined to the chamber bottom 15 by means of a rolling-diaphragm-type spring element 14 that is formed integrally with the resonator 5. In this case, the orifices make up 25% of the top surface of the orifice plates directed toward the sound source. As a result, a good sound absorption results from a broad frequency range and, on the other hand, adequate inherent stability is achieved for the entire noise damper.

Figure 4:
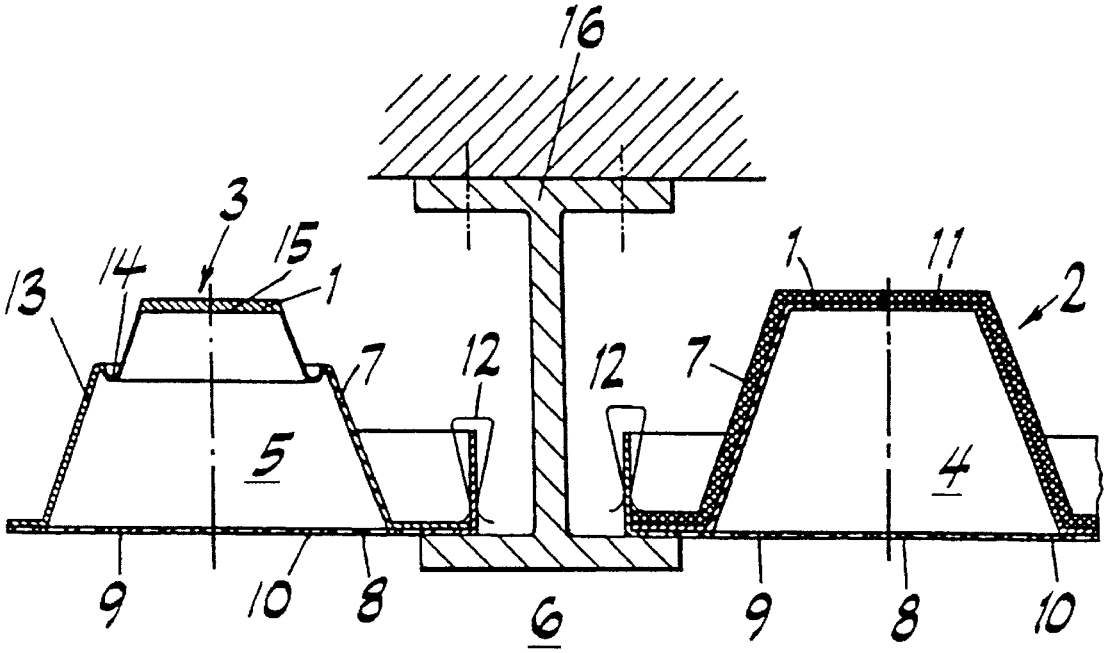
FIG. 4 shows a detail similar to the detail of FIG. 3, with dissimilar noise dampers and a different fixing device being used.

FIG. 4 shows an exemplary embodiment similar to the one in FIG. 3. On the side facing away from the sound source 6, the resonator 4 is provided with a heavy layer 11 for absorbing lower frequency vibrations in the range of up to 500 Hz. The resonator 5 is provided with a chamber bottom 15 that is coupled from the side walls 13 by a spring element 14. The noise dampers of FIG. 4 are intended to be used as ceiling covering and are secured by a clamp-type fixing device to a support 16.

What is claimed is:

1. A noise damper comprising a molded part of polymer material having at least two chambers and an orifice plate covering the molded part on a side of the molded part facing a sound source, wherein the chambers are designed as resonators with at least two of the chambers having resonant frequencies that differ from one another;

wherein the molded part is comprised of a closed-cell material;

wherein the chambers are formed as essentially cup-shaped protrusions that open toward the sound source;

wherein the orifice plate comprises at least two openings leading into each chamber;

wherein said molded part and said orifice plate are detachably joined together; and wherein the number and/or shape of the openings in the orifice plate leading into the chambers differs for at least two of the chambers.

2. A noise damper comprising a molded part of polymer material having at least two chambers and an orifice plate covering the molded part on a side of the molded part facing a sound source, wherein the chambers are designed as resonators with at least two of the chambers having resonant frequencies that differ from one another;

wherein the molded part is comprised of a closed-cell material;

wherein the chambers are formed as essentially cup-shaped protrusions that open toward the sound source;

wherein the orifice plate comprises at least two openings leading into each chamber;

wherein said molded part and said orifice plate are detachably joined together; and wherein the molded part comprises a foamed plastic and the orifice plate comprises a perforated plate of metallic material.

3. The noise damper according to claim 1, wherein the molded part is provided with chambers of the same volume and dimensions.

4. The noise damper according to claim 2, wherein the molded part is provided with chambers of the same volume and dimensions, and wherein the number and/or shape of the openings in the orifice plate leading into the chambers differs for at least two of the chambers.

5. The noise damper according to claim 1, wherein the molded part is designed with at least two chambers having different volumes.

6. The noise damper according to claim 2, wherein the molded part is designed with at least two chambers having different volumes, and wherein the number and/or shape of the openings in the orifice plate leading into the chambers is the same for at least two of the chambers.

7. The noise damper according to claim 2, wherein the molded part is designed with at least two chambers having different volumes, and wherein the number and/or shape of the openings in the orifice plate leading into the chambers differs for at least two of the chambers.

8. The noise damper according to claim 1, wherein the ratio of the sum of the surface areas of all openings to the total surface area of the orifice plate is 0.05 to 0.45.

9. The noise damper according to claim 2, wherein the ratio of the sum of the surface areas of all openings to the total surface area of the orifice plate is 0.05 to 0.45.

10. The noise damper according to claim 1, wherein the openings are circular in shape and have a diameter of not more than 4 mm.

11. The noise damper according to claim 2, wherein the openings are circular in shape and have a diameter of not more than 4 mm.

12. The noise damper according to claim 1, wherein the chambers have a cross-section that widens conically toward the orifice plate.

13. The noise damper according to claim 2, wherein the chambers have a cross-section that widens conically toward the orifice plate.

14. The noise damper according to claim 1, wherein the molded part is provided with a heavy layer on the side facing away from the orifice plate.

15. The noise damper according to claim 2, wherein the molded part is provided with a heavy layer on the side facing away from the orifice plate.

16. The noise damper according to claim 1, wherein the noise damper is constructed as a ceiling and/or wall covering.

17. The noise damper according to claim 2, wherein the noise damper is constructed as a ceiling and/or wall covering.

* * * * *